US005669029A

United States Patent [19]

Fyson et al.

[11] Patent Number: 5,669,029

[45] Date of Patent: Sep. 16, 1997

[54] PHOTOGRAPHIC PROCESSING

[75] Inventors: John Richard Fyson, Hackney; Christopher Barrie Rider, New Malden; Andrew Benoy, Herts, all of England

[73] Assignee: Eastman Kodak Company, Rochester, N.Y.

[21] Appl. No.: 642,384

[22] Filed: May 3, 1996

[30] Foreign Application Priority Data

May 4, 1995 [GB] United Kingdom ..... 9509040

[51] Int. Cl.[6] ..... G03D 3/06; G03C 5/31

[52] U.S. Cl. ..... 396/566; 396/626; 430/398; 430/399

[58] Field of Search ..... 354/298, 324; 430/398, 399, 400; 396/566, 567, 568, 569, 570, 578, 626

[56] References Cited

U.S. PATENT DOCUMENTS

| | | | |
|---|---|---|---|
| 4,469,424 | 9/1984 | Matsui et al. . | |
| 4,486,082 | 12/1984 | Wagner et al. . | |
| 4,527,878 | 7/1985 | Taniguchi et al. . | |
| 5,073,464 | 12/1991 | Osawa et al. . | |
| 5,162,106 | 11/1992 | Kunda et al. | 430/400 |
| 5,235,369 | 8/1993 | Nakamura et al. . | |
| 5,252,439 | 10/1993 | Nakamura | 430/399 |
| 5,315,337 | 5/1994 | Skye et al. . | |
| 5,400,105 | 3/1995 | Koboshi et al. | 354/324 |
| 5,416,552 | 5/1995 | Fakler | 354/324 |
| 5,452,276 | 9/1995 | Baas . | |
| 5,477,300 | 12/1995 | Fujimoto et al. | 354/298 |

FOREIGN PATENT DOCUMENTS

| | | |
|---|---|---|
| 381502 A1 | 8/1990 | European Pat. Off. . |
| 0 456 684 | 6/1994 | European Pat. Off. . |
| 91/12567 | 8/1991 | WIPO . |
| 91/19226 | 12/1991 | WIPO . |
| 92/10790 | 6/1992 | WIPO . |
| 92/17370 | 10/1992 | WIPO . |
| 92/17819 | 10/1992 | WIPO . |
| 93/03415 | 2/1993 | WIPO . |
| 93/04404 | 3/1993 | WIPO . |

*Primary Examiner*—A. A. Mathews
*Attorney, Agent, or Firm*—Frank Pincelli

[57] ABSTRACT

A method of controlling the replenishment of a processing solution used for processing a photographic material in photographic processing apparatus, wherein replenishment chemistry is added to the processing solution and the replenishment rate is controlled using an algorithm, is characterised in that at least one of the terms of the algorithm is determined by information associated with the replenishment chemistry.

7 Claims, No Drawings

PHOTOGRAPHIC PROCESSING

FIELD OF THE INVENTION

The invention relates to photographic processing. More particularly, it relates to the replenishment of a processing solution used in the processing of a photographic material.

BACKGROUND OF THE INVENTION

As the chemicals in the baths of a photographic processor are used up, replenishment chemicals must be added to the baths in order to keep the activities and concentrations of the chemicals constant.

The amount of replenishment is dependent on many factors, e.g., light exposure given to the photographic material, the properties of the photographic material and the ability of the replenisher to restore a process tank solution to its aim concentration.

The replenishment of a process is often carried out automatically. This may be accomplished by using an algorithm or look-up table for calculating the amount of replenishment required. The algorithm may be dependent on area alone as practised in most automatic processing machines; or it may be dependent on exposure as described in EP-A-0,596,994; U.S. Pat. No. 5,235,369; EP-A-0,500,278; EP-A-0,456,684 and U.S. Pat. No. 4,486,082; or the algorithm may be dependent on the amount of silver developed in a black and white system as taught by EP-A-0,596,991, U.S. Pat. Nos. 5,315,337, 5,073,464, GB-A-2,108,707 and GB-A-2,106,666.

PROBLEM TO BE SOLVED BY THE INVENTION

The ability of the replenisher to restore a process tank solution to its aim concentration may be variable because of variation in the manufacture of the kits used to make the replenisher. This variation may be determined by analysis and corrected, but the correction may involve remaking the kits which is often time consuming.

A variation in kit composition might be notified to the user by a leaflet suggesting a change be made to the setting of replenishment pumps. This means that if materials come in as a mixture of old and new forms the replenishment rate has to be reset manually or the products segregated for processing in machines with different replenishment characteristics. This is costly, time consuming and inconvenient.

SUMMARY OF THE INVENTION

The invention provides a method of controlling the replenishment of a processing solution used for processing a photographic material in photographic processing apparatus wherein replenishment chemistry is added to the processing solution and the replenishment rate is controlled using an algorithm characterised in that at least one of the terms of the algorithm is determined by information associated with the replenishment chemistry.

ADVANTAGEOUS EFFECT OF THE INVENTION

Variations in the replenishment chemistry supplied to a processor are taken into account in a convenient manner.

Wider tolerances can be used in the manufacture of replenishment chemistry because the information associated with the replenishment chemistry can be based on the manufacturer's analysis of actual solution concentrations.

This is especially advantageous for solutions which are difficult to make.

DETAILED DESCRIPTION OF THE INVENTION

Replenishment of a processing solution may be controlled as a function of one or more parameters relating to the photographic material being processed and/or the process itself. For example, such parameters include the area of the photographic material processed in unit time, the degree to which the material is exposed to activating radiation and the amount of silver developed. Terms representing these parameters can be contained in an algorithm or look-up table which is used to determine the rate of replenishment required.

In accordance with the invention, replenishment is controlled as a function of a parameter relating to the replenishment chemistry, i.e., the algorithm or look-up table comprises a term representing that parameter. Information representing that parameter is associated with the replenishment chemistry. At least one of the terms of the algorithm or look-up table used to determine the rate of replenishment is determined by the information associated with the replenishment chemistry.

Replenishment chemistry refers to substances added to a process solution to correct deficiencies which would occur over time in the absence of such addition. Process solutions include developer, fixer, bleach, bleach-fix and wash solutions. The replenishment chemistry may be provided in the form of a solution or as a solid. For any given process solution, it may be provided in separate parts requiring mixing and it may be provided at working strength or as a concentrate requiring dilution.

The information associated with the replenishment chemistry may represent a variety of replenishment chemistry parameters, e.g., pH, relative activity, specific gravity and concentration, e.g., developing agent concentration and buffer concentration.

Under certain conditions, the chemical activity of some replenishment solutions varies with age since manufacture. For example, developer replenishment solutions are known to oxidise gradually with time. If the rate of change of solution activity is known, information associated with the replenishment chemistry concerning its date of manufacture may be used to estimate the current activity of the solution. Replenishment rates for the solution may then be adjusted accordingly.

The information can be associated with the replenishment chemistry in a number of ways. For example, the information may be present on a container or packaging in which the replenishment chemistry is supplied. Alternatively, the information may be present on separate identification means provided with the replenishment chemistry e.g. a card or sheet displaying the information, a magnetic storage medium, e.g., a floppy disk holding the information or a "smartcard" which incorporates an integrated circuit containing the information.

The information may be in any suitable form. It might be visibly presented, e.g., in the form of numbers or letters. Such information can be read and entered manually in a replenishment chemistry management system. Alternatively, the information may be machine-readable e.g. in the form of a bar-code or a magnetic stripe.

Additional information can be associated with the replenishment chemistry in the manner described above for different purposes. For example, the information may represent the type of replenishment chemistry e.g. developer (parts A, B, C, etc.), fix, wash, wash additive, bleach, bleach-fix, hardener and conditioner. The information may indicate whether a solution is supplied at working strength or as a concentrate in which case an indication of the dilution required can be given. This provides a way of checking the correct connection of a solution to a processor. The additional information may provide details of the date of manufacture of a processing solution, its expiry date or the site of manufacture to enable error tracking and trouble shooting. The additional information may indicate the type of photographic process in which the processing solution is to be used, e.g., E6, C41, graphics, etc. This provides a way of checking that the correct solution is used for the correct process, e.g., a way of ensuring that E6 color developer is not used for C41 film process. The use of process type indication could enable the modification of a replenishment rate by taking into account the use of an incorrect processing solution such as a fixer, e.g., a graphic arts fixer used in a radiographic processor, or a C41 fixer used instead of a E6 fixer.

The invention may be employed in any photographic processing apparatus. Such apparatus may include means for imagewise exposing a photographic material and means for processing the exposed material to produce the recorded image. The processing means will normally provide a combination of processing stages selected from development, fixing, bleaching and washing stages depending on the type of material being processed.

Any photographic processor known in the art can be used to process the photosensitive materials described herein. For example, large volume processors, and so-called minilab and microlab processors may be used. Other examples include the Low Volume Thin Tank processors described in such references as WO 92/10790, WO 92/17819, WO 93/04404, WO 92/17370, WO 91/19226 and 91/12567.

The replenishment of a processing solution, e.g., a developer solution may be carried out manually or, preferably, by other controlled means of addition. A preferred means for controlling the supply of replenisher is a chemical management system comprising a computer which calculates the amount of replenishment required in accordance with the algorithm or look-up table. In order to do this, the computer receives signals representing the terms used in the algorithm. In addition to the term determined by the information associated with the replenishment chemistry, the algorithm may comprise other terms e.g. terms relating to the degree of exposure of the photographic material and the area of material processed.

An exposure term in the algorithm may be determined by obtaining information from the exposure device, by visual estimation or, if replenishment is made for the material after processing, by scanning the final image and using a density to exposure function.

An area term can be obtained by recording the number of sheets of known area being processed or by timing the passage of material of known width through the processor.

The algorithm or look-up table may also have additional terms, e.g., relating to the rate of oxidation of the developer and solution evaporation in a particular processor. These rates would be determined by measurement or by models considering the geometry of the processor.

The algorithms or look-up tables may be determined by experiment or by model calculations.

The computer in the chemical management system may be used to control the operation of a pump supplying replenisher to a tank of process solution. For example, by timing the operation of the pump a desired amount of replenisher can be added.

The method of the invention can be used in the processing of a variety of silver halide photographic materials including both colour and black and white materials. Examples of such materials are described in Research Disclosure, September 1994, Number 365 published by Kenneth Mason Publications Limited, (hereinafter referred to as Research Disclosure), Section I.

Photographic processing solutions for development, fixing, bleaching, washing, rinsing and stabilizing and their use are described in Research Disclosure, Sections XIX and XX.

The composition of the replenishment solution will depend on the processing solution. For example, a developer replenishment solution may have the same composition as the developer or it may be a more concentrated version thereof.

In a specific embodiment of the invention, a high contrast silver halide film, e.g., Kodak Focus HeNe film is exposed by a scanning laser in an imagesetter, e.g., a Herkules imagesetter (Linotype-Hell AG). Appropriate hardware and software is used to calculate the number of exposed pixels per page, i.e., a signal is derived which is indicative of the exposure of the film.

The imagesetter is provided with a bar-code reading wand and a bar-code decoder. Information contained in a bar-code on the packaging of a developer solution used in the processor is read using the wand attached to the imagesetter.

The exposed film is conveyed to a processor, a Multiline 550 processor (Glunz & Jensen International A/S) which provides a four stage (develop/fix/wash/dry) rapid access process. The processor comprises a chemical management system including a computer which calculates and supplies the required amount of developer replenisher based on information received relating to the exposure of the photographic material, developer solution parameters and processor usage. A communication link is provided between the imagesetter and the processor so that the exposure information and developer solution information generated in the imagesetter can be provided to the chemical management system. Information relating to the average amount of photographic material processed in unit time can be generated in the processor from sensors which detect the number of sheets of a given area passing through the processor in a given time.

The invention is further illustrated by way of example as follows.

EXAMPLE 1

Different Replenisher pHs

Processing accuracy for high contrast imagesetter films is very dependent on the pH of the developer. It is difficult to make the developer replenisher to a required pH but it is relatively easy to determine the pH of the mix. This information is bar-coded on the side of the packing as two additional digits with the product code. The pH information is coded at 100 times the (measured pH - 10.00). This bar-code is read by a bar-code reading wand attached to the imagesetter and the decoded pH information sent to a photographic processor fitted with a replenishment control computer, to which it is attached, by an electronic connection using an appropriate protocol. The computer in the processor controls the replenishment rate of the developer.

The development algorithm used in the processor for Kodak™ IMAGELITE™ LD film is as follows:

Replenishment rate=16(−3+3.76EXP+1465AREA−15621AREA$^2$)/(pHactor−40)ml/sq.m, wherein EXP=exposure in %

AREA=(Last sheet area in metres$^2$)/(time since start of the last sheet in minutes). If AREA>0.10 then AREA is set to 0.10.

pHactor is the pH factor read from the developer replenisher packaging.

Two developers were supplied with the following formulae:

| | |
|---|---|
| Hydroquinone | 33 g/l |
| Sodium Bromide | 1.9 g/l |
| Hydroxymethyl Methyl Phenidone | 0.8 g/l |
| Benzotriazole | 0.22 g/l |
| Phenyl Mercapto Tetrazole | 0.013 mg/l |
| Sodium metabisulphite | 42 g/l |
| Diethylene glycol | 35 ml/l |
| Potassium Carbonate (47%) | 42 g/l |
| pH | 10.56 or 10.61 |

The starting solution had the following composition:

| | |
|---|---|
| Hydroquinone (HQ) | 25 g/l |
| Sodium Bromide | 3.8 /l |
| Hydroxymethyl Methyl Phenidone | 0.8 g/l |
| Benzotriazole (BTAZ) | 0.20 g/l |
| Phenyl Mercapto Tetrazole | 0.013 mg/l |
| Sodium metabisulphite | 38 g/l |
| Diethylene glycol | 35 mls/l |
| Potassium Carbonate (47%) | 42 g/l |

The effect of these two replenishers with different pH was modelled in accordance with the following model.

DEFINITIONS FOR MODEL

Mass_in - the mass of a component entering the process tank in unit time(e.g. g/day)

Mass_out - the mass of a component leaving the process tank in unit time(e.g. g/day)

Volume_in - the volume of liquid entering the process tank in unit time(e.g. mls/day)

Volume_out - the volume of liquid leaving the process tank in unit time(e.g. mls/day)

Usage - the amount of the component being considered that is consumed by 1 m$^2$ of material (a positive number indicates a loss of material)(e.g.g/m$^2$)

Tank_conc - the concentration of the component being considered in the processor tank(e.g.g/l)

Tank-conc_initial - the concentration of the component being considered at time=0(e.g. g/l)

Area - the area of photographic material processed in unit time(e.g. m$^2$/day)

Rep_rate - replenishment rate per unit area(e.g. mls/1)

Anti-ox - volume of additional replenisher added per unit time that is independent of processed area (sometimes known as time dependent replenishment (TDR))(e.g. mls/day)

Top-up - Additional volume of replenisher added to tank at the beginning of unit time to make up for evaporation. This is set to zero in mass equations only if top-up is with water(e.g. mls/day)

Time - the time elapsed in appropriate units (e.g. days)

Overflow_mass - mass of component lost by tank overflow to drain in unit time (e.g. g/day)

Overflow-vol - volume of liquid lost by tank overflow to drain in unit time(e.g. mls/day)

Carryout_mass - mass of component carried out on material web in unit time (e.g. mls/day)

Carryout_vol - volume of liquid carried out on material web in unit time(e.g. mls/day)

Oxidation - the total mass of the component being considered lost in unit time(tank size dependent)(e.g. g/tank/day)

Evaporation - the volume of liquid lost from the processing tank being considered in unit time(e.g. mls/tank/day)

Tank_volume - the volume of the tank being considered (e.g. mls)

The Model Mass_in=(Area*Rep_rate+Anti-ox+Top-up)*Rep_conc Volume_in=Area*Rep_rate+Anti-ox+Top-up Mass_out=(Carryout_mass+Overflow_mass)+Area*Usage+Oxidation Volume_out=(Carryout_vol+Overflow_vol)+Evaporation Rate of change of mass with time=(Area*Rep_rate+Antiox+Top-up)*Rep_conc -(Carryout_mass+Overflow_mass)−Area*Usage−Oxidation If Volume_in=Volume_out (Carryout_vol+Overflow_vol)=Area*Rep_rate+Anti-ox+Top-up−Evaporation (Carryout_mass+Overflow_mass)=(Carryout_vol+Overflow_vol ) * Tank_conc (Carryout_mass+Overflow_mass)=(Area*Rep_rate+Anti-ox+Top-up−Evaporation) * Tank_conc Rate of change of mass with time=(Area*Rep_rate+Anti-ox +Top-up)*Rep_conc−Area*Usage−Oxidation −(Area*Rep_rate+Anti-ox+Top-up−Evaporation) * Tank_conc Let a=(Area*Rep_rate+Anti-ox+Top-up)*Rep_conc−Area*Usage−Oxidation Let b=(Area*Rep_rate+Anti-ox+Top-up−Evaporation) Rate of change of mass with time=a−b*Tank_conc Rate of change of concentration with time=(a−b*Tank_conc)/Tank_volume Integrating with respect to the limits: Tank_Conc=(a−(a−b*Tank_conc_initial) *exp ( (−b* time)/tank_volume))/b When time is infinite, i.e. a totally seasoned process, Tank_conc=a/b The aim replenishment rate was calculated using the model with the two developers of different pH.

The replenishment algorithm in the processor was used and the final values of pH calculated. Using both replenishers with the appropriate factor read off the packaging by the imagesetter gave a final pH of 10.40 showing that the algorithm in this form could cope with changes in replenisher pH so long as the information was read to the processor.

We claim:

1. A method of controlling the replenishment of a processing solution used for processing a photographic material in a photographic processing apparatus, comprising the steps of:

adding replenishment chemistry to the processing solution; and controlling the replenishment rate of said replenishment chemistry by using an algorithm having at least one of the terms of the algorithm determined by information associated with the replenishment chemistry.

2. A method according to claim 1 further comprising the step of providing the information associated with the replenishment chemistry in a machine-readable form.

3. A method according to claim 2 further comprising the step of providing the machine-readable form as a bar code.

4. A method according to claim 2 further comprising the step of providing the machine-readable form as a magnetic recording.

5. A method according to claim 1 further comprising the step of providing the information associated with the replenishment chemistry as it relates to pH.

6. A method according to claim 1 wherein the replenishment chemistry is development replenishment chemistry and the algorithm comprises terms relating to the degree of exposure of the photographic material and the are of the photographic material.

7. A method according to claim 1 wherein the replenishment chemistry is fixer replenishment chemistry.

* * * * *